United States Patent [19]

Parker et al.

[11] Patent Number: 4,966,002

[45] Date of Patent: Oct. 30, 1990

[54] PROCESS AND APPARATUS FOR PRODUCING NITROGEN FROM AIR

[75] Inventors: Clayton E. Parker, Somerset; Robert A. Mostello, Somerville, both of N.J.

[73] Assignee: The BOC Group, Inc., Murray Hill, N.J.

[21] Appl. No.: 392,816

[22] Filed: Aug. 11, 1989

[51] Int. Cl.[5] ..... F25J 3/02

[52] U.S. Cl. ..... 62/31; 62/39

[58] Field of Search ..... 62/13, 31, 32, 36, 38, 62/39

[56] References Cited

U.S. PATENT DOCUMENTS

| | | | |
|---|---|---|---|
| 3,203,193 | 8/1965 | Ruhemann et al. | 62/13 |
| 3,217,502 | 11/1965 | Keith, Jr. | 62/13 |
| 4,400,188 | 8/1983 | Patel et al. | 62/13 |
| 4,566,887 | 1/1986 | Openshaw | 62/39 |
| 4,715,873 | 12/1987 | Auvil et al. | 62/13 |
| 4,867,773 | 9/1989 | Thorogood et al. | 62/39 |

OTHER PUBLICATIONS

Heat Pumps in Distillation by H. R. Null, Monsanto Co., St. Louis, Mo.; CEP Jul. 1976, pp. 58–64.

*Primary Examiner*—Ronald C. Capossela

*Attorney, Agent, or Firm*—Carol A. Nemetz; Robert I. Pearlman

[57] ABSTRACT

Process for the recovery of nitrogen from air in which gaseous air is compressed, cooled and optionally purified in a heat exchanger, and then distilled to obtain pure gaseous nitrogen overhead and an oxygen enriched liquid bottoms, wherein all of the bottoms and a portion of the overhead is passed to a condenser to form an oxygen enriched gas and liquid nitrogen and wherein at least a portion of the oxygen enriched gas is compressed and recycled to the distillation column to enhance recovery of the nitrogen product.

10 Claims, 5 Drawing Sheets

PROCESS AND APPARATUS FOR PRODUCING NITROGEN FROM AIR

FIELD OF THE INVENTION

The present invention is directed to a cryogenic superatmospheric process and apparatus for the separation of air to produce gaseous nitrogen and optionally liquid nitrogen with higher recovery rates by compressing a waste nitrogen product and recycling the compressed waste to the distillation column.

BACKGROUND OF THE PRIOR ART

Processes for the separation of air to produce nitrogen are known, as disclosed for example, in Ruhemann et al., U.S. Pat. No. 3,203,193 and Keith, Jr., U.S. Pat. No. 3,217,502. These processes provide for the operation of the single distillation column at a slightly higher pressure than the product delivery pressure. Air is introduced at the column sump. The oxygen enriched liquid air withdrawn from the distillation column flashes in indirect heat exchange with a portion of the overhead nitrogen product. In addition, plant refrigeration is provided by further expanding the vaporized oxygen enriched air, also termed "waste nitrogen." Such methods ae able to recover up to about 35 to 40 mole percent of the feed air as nitrogen product.

Patel et al., U.S. Pat. No. 4,400,188, discloses the use of a heat pump to separate nitrogen. The process, however, is only cost effective for the production of very large quantities of nitrogen, e.g. 15 to 200 million standard cubic feet/day (SCFD) (that is, 625,000 to 8,000,000 SCFH). The process uses overhead vapor recompression to enhance separation which requires complex and costly equipment making it uneconomical for recoveries in the range of less than about 15 million SCFD (625,000 SCFH).

Conventional single distillation column systems, which expand waste nitrogen in a turboexpander for refrigeration generally filter and compress the feed air to above the nitrogen delivery pressure. The air is purified of its carbon dioxide and moisture contents by adsorptive means, such as molecular sieves, and then cooled to near its dew point temperature. Alternatively, carbon dioxide and condensed moisture are removed in a reversing heat exchanger, in which the air and waste stream passages can be alternated, which allows the deposited impurities to evaporate into the waste stream which is ejected to the atmosphere.

The cooled air stream is fed to a distillation column where it is separated into an oxygen-rich liquid at the base of the column and a substantially pure nitrogen gas stream at the top. A portion of the pure nitrogen gas is warmed to ambient temperature and delivered as product. The balance is sent to a condenser to provide column reflux. Vaporized oxygen-rich liquid (typically termed "waste nitrogen") from the condenser is warmed in a heat exchanger and then expanded in a turboexpander to provide refrigeration for the system. Such systems characteristically recover only about 35–45 mole percent of the feed air as nitrogen product. It is therefore a significant advance in the art if the mole percent recovery of nitrogen from the feed air is significantly increased.

SUMMARY OF THE INVENTION

The present invention provides a process and apparatus for the recovery of nitrogen from air at high yields by compressing a stream of waste nitrogen composition and reinjecting it into the distillation column. Pure nitrogen product is produced at considerably less power than conventional systems employing a single distillation column. Further, at least a portion of the work output of a turboexpander may drive the compressor for compressing the recycled waste nitrogen. Also, liquid nitrogen may be recovered as a product.

The present invention comprises a process and apparatus to recover nitrogen from a gaseous feed air. Compressed air is cooled in a heat exchanger against the nitrogen product stream and waste nitrogen stream which are warmed and, optionally, treated to remove impurities such as in a reversing heat exchanger. Alternatively, a molecular sieve may be used to remove impurities prior to forwarding the air to a non-reversing heat exchanger.

The resulting cooled air is distilled to produce substantially pure gaseous nitrogen overhead and an oxygen enriched liquid bottoms. A portion of the nitrogen overhead and substantially all of the oxygen enriched bottoms are passed to a condenser to thereby form liquid nitrogen, at least a part of which is returned to the distillation means as reflux, and an oxygen enriched gas, termed "waste nitrogen."

In accordance with one aspect of the invention, at least a portion of the waste nitrogen is not turboexpanded, but rather is warmed to ambient temperature and then compressed. The compressed gas is then cooled and recycled into the distillation column. Substantially pure nitrogen gas is recovered in an amount of up to about 70 mole percent based on the feed air.

In accordance with another aspect of the invention, a portion of the waste nitrogen obtained from the condenser is not turboexpanded, but rather is sent to a cold compressor without first being warmed to ambient temperature. Also, a portion of the work output from the turboexpander may be supplied to the cold compressor.

Alternatively, even higher outputs of nitrogen product can be achieved by using all of the work output from the turboexpander to operate a cold compressor. In this case, refrigeration is supplied to the system from an external source such as additional liquid nitrogen being provided to the distillation column.

BRIEF DESCRIPTION OF THE DRAWINGS

The following drawings in which like reference characters indicate like parts illustrate embodiments of the invention and are not meant to limit the scope of the invention as encompassed by the claims forming part of the application.

DETAILED DESCRIPTION OF THE INVENTION

Figure 1:
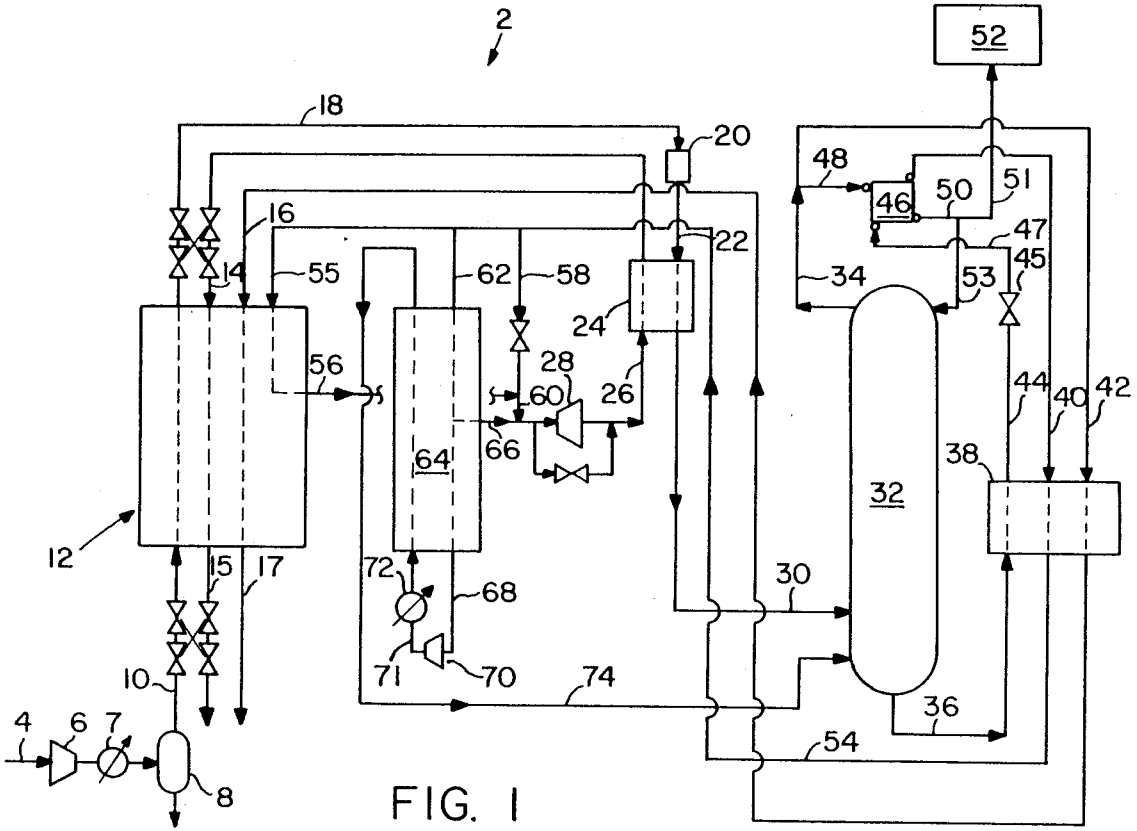
FIG. 1 is a schematic view of one embodiment of the invention using multiple heat exchangers and a reversing heat exchanger wherein the entire waste nitrogen stream is warmed, and a portion of the warmed product is compressed and returned to the distillation column.

Referring to the drawings and particularly to FIG. 1, the nitrogen recovery system 2 of the present invention provides for a stream of feed air 4 to be fed into a compressor 6. The compressed air is forwarded to an aftercooler 7 for the purpose of cooling and condensing water vapor. Thereafter, the condensate is removed in separator 8 and air 10 exits. Air 10 enters heat exchanger 12 where the air is cooled in heat exchange relationship with oxygen enriched gas 14 and nitrogen product stream 16.

The cooled air 18 then enters an optional gas phase absorber 20 which adsorbs impurities such as carbon dioxide and hydrocarbons. The filtered air 22 proceeds to an optional heat exchanger 24 where the air is further cooled against the countercurrent flow of oxygen enriched gas 26 from a turboexpander 28.

The cooled air 30 exiting heat exchanger 24, which is near saturation and may be partly liquefied, enters distillation column 32 at an intermediate stage. The cooled air 30 is separated via distillation into a substantially pure gaseous nitrogen overhead 34 which exits at the top of the column 32 and an oxygen enriched liquid bottoms exiting 36 from the column bottom. The liquid 36 is cooled in an optional heat exchanger 38 against oxygen enriched gas 40 and nitrogen product gas 42. The cooled liquid 44 then proceeds to valve 45 where its pressure is reduced, and then to condenser 46 via line 47 where it boils while condensing a portion 48 of the gaseous nitrogen overhead 34 through indirect heat exchange.

The boiled oxygen enriched gas stream 40 is heated in heat exchanger 38 and exits via stream 54. The condensed liquid nitrogen 50 exiting condenser 46 is split, and a portion 51 is optionally collected in a conventional storage facility 52. The major portion of the condensed liquid nitrogen 50 returns to the distillation column 32 via line 53 where it serves as reflux. The remaining portion of the gaseous nitrogen overhead 42 absorbs heat in heat exchanger 38. The resulting heated nitrogen 16 further absorbs heat in heat exchanger 12, and thereafter is passed via line 17 out of the system 2 for use as product nitrogen.

A first portion 55 of the oxygen enriched gas 54 exiting condenser 46 is heated via passage through heat exchanger 12 where it serves to cool the feed air 10 and exits via line 56. A second portion 58 of the oxygen enriched gas 54 bypasses heat exchanger 12, and combines with the warmed gas 56 into line 60. Oxygen enriched gas 60 enters the turboexpander 28, and expands to nearly atmospheric pressure producing refrigeration required to keep the system 2 cold. The expanded gas 26 exiting the turboexpander 28 is used to further cool air, first in heat exchanger 24, and then via line 14 in heat exchanger 12. The gas 15 exiting heat exchanger 12 is now termed "waste nitrogen" since it is normally a waste product. For the embodiment shown in FIG. 1, heat exchanger 12 is a reversing heat exchanger in which there is periodic alternating use of air passages with waste nitrogen passages for the purposes of both exchanging heat and of depositing water and carbon dioxide impurities from the air followed by evaporation of these impurities into the waste nitrogen stream.

A third portion 62 of the oxygen enriched gas 54 is warmed in heat exchanger 64, preferably to ambient temperature. A portion of the warmed gas 66 may enter turboexpander 28. The balance 68 of the third portion 62 is compressed to a pressure about equal to or slightly greater than the distillation column 32 operating pressure via compressor 70. The compressed gas 71 is cooled in after cooler 72, cooled to a low temperature in heat exchanger 64, and recycled via the line 74 to the bottom of the distillation column 32 where it serves as "boil up", thus increasing the nitrogen recovery possible from the feed air to system 2. The addition of feed air 30 at an intermediate stage and recycled enriched oxygen at the bottom creates a compound column allowing for a stripping section between the inlets of those two streams.

Figure 2:
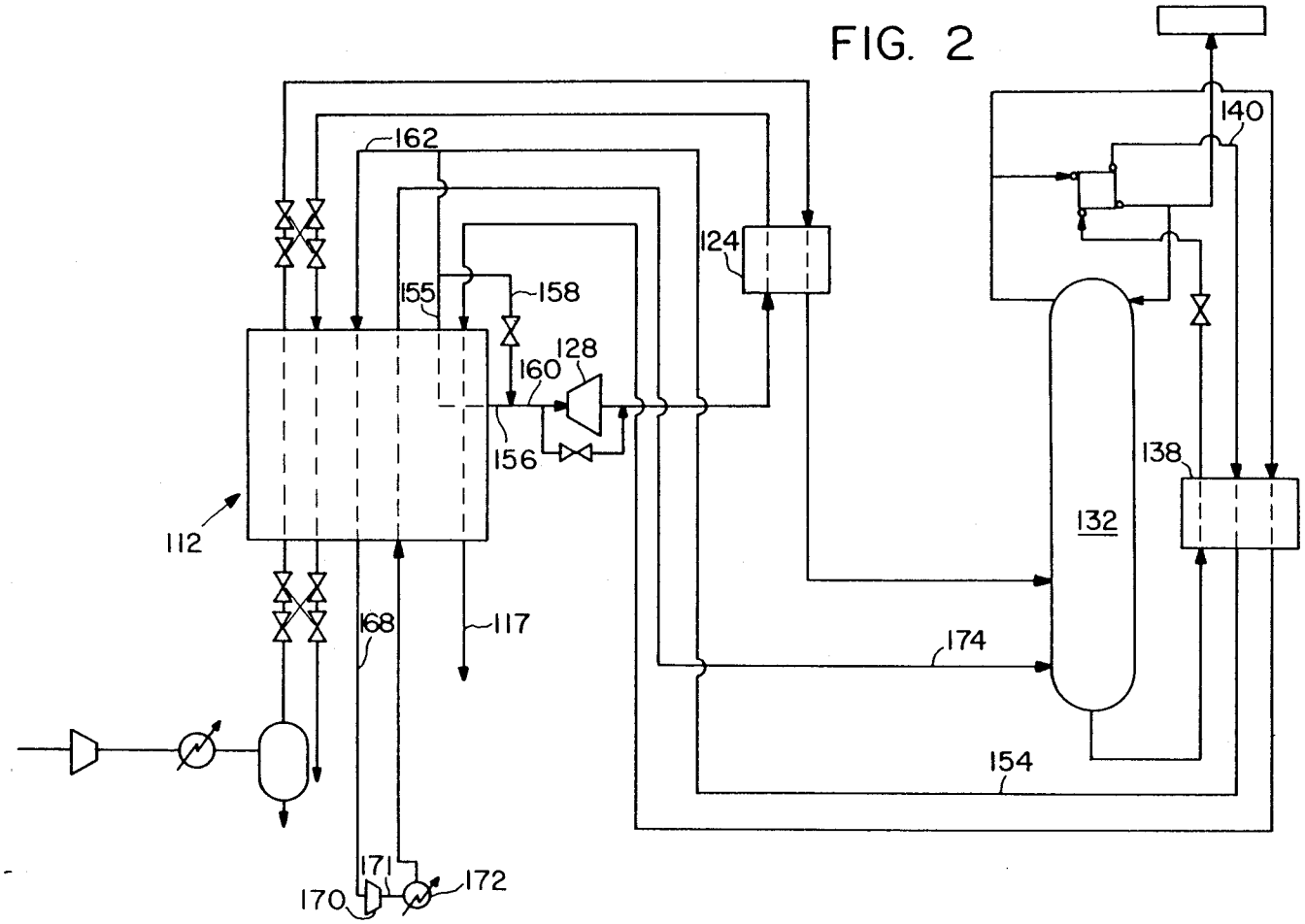
FIG. 2 is a schematic view of another embodiment of the warm compression cycle using one less heat exchanger.

In the embodiment shown in FIG. 2, heat exchanger 64 of FIG. 1 has been eliminated in favor of passing the oxygen enriched gas through the heat exchanger 112 before entering turboexpander 128 and compressor 170. Product nitrogen 117 is withdrawn from heat exchanger 112.

More specifically, the oxygen enriched gas 140 is warmed in the optional heat exchanger 138. A first portion 155 of the oxygen enriched gas 154 is warmed in heat exchanger 112 where it absorbs heat and exits via line 156. A second portion 158 of the oxygen enriched gas 154 bypasses the heat exchanger 112 and combines with stream 156. The combined stream 160 enters turboexpander 128, expands to nearly atmospheric pressure to provide refrigeration, and exits the system via the optional heat exchanger 124 and the main reversing heat exchanger 112.

A third portion 162 of the oxygen enriched gas 154 passes completely through the heat exchanger 112 and into the compressor 170. The compressed gas 171 is then passed through the after cooler 172, back through heat exchanger 112, and flows via line 174 as the recycle back to the bottom of distillation column 132.

Figure 3:
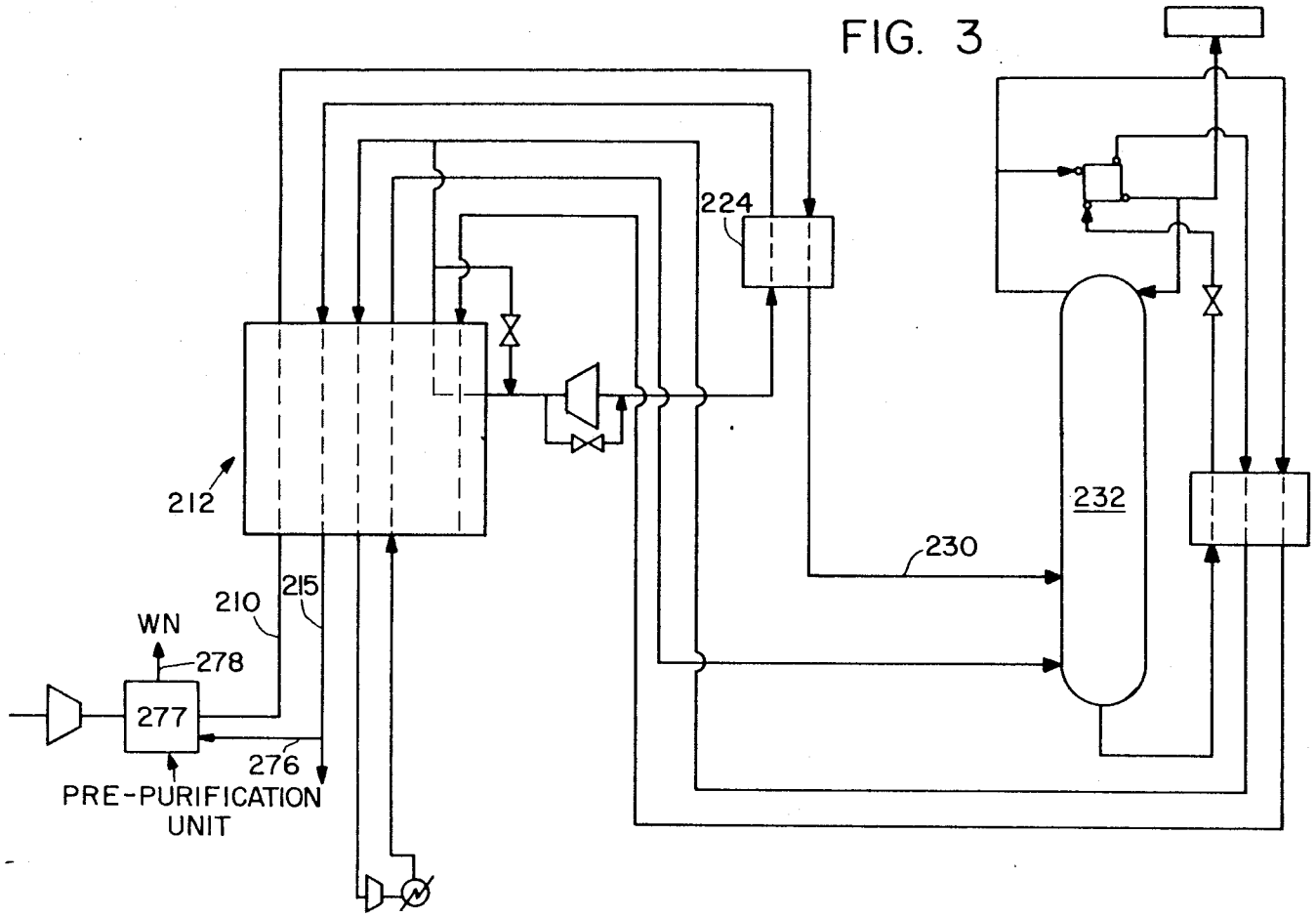
FIG. 3 is a schematic view of another embodiment of the warm compression cycle using a non-reversing heat exchanger and a molecular sieve for air purification.

Referring to FIG. 3, there is provided an embodiment of the invention similar to that shown in FIG. 2 in which purification of the feed air occurs outside of the heat exchanger 212 and therefore a non-reversing heat exchanger is employed.

The compressed feed air is forwarded to a prepurification unit 277 which customarily contains a regenerable molecular sieve made of a zeolitic material which removes impurities such as carbon dioxide, some hydrocarbons and water vapor. The purified air 210 passes through the heat exchanger 212 through optional heat exchanger 224, and into the bottom of distillation column 232 via line 230.

In addition, the embodiment shown in FIG. 3 differs from that shown in FIG. 2 with respect to the treatment of the waste nitrogen product passing through the heat exchanger 212. A portion 276 of the waste nitrogen product 215 is sent to the prepurification unit 277 to serve as regeneration gas, which is normally heated before entering the prepurification unit 277, and exits line 278.

The embodiments in FIGS. 1–3 are all directed to compression of warm oxygen-enriched gas. That is, oxygen-rich waste nitrogen is warmed to essentially ambient temperature in a heat exchanger before being compressed and recycled back to the distillation column.

The present invention improves nitrogen recovery from a base recovery possible without compression of a recycle waste nitrogen stream. An additional embodiment of this invention deals with cold compression of the waste nitrogen as a means of achieving improved recoveries in a process efficient manner.

Another aspect of the present invention takes advantage of excess refrigeration energy available in the turboexpanded stream and of the shaft work economy in compressing a gas in cold state. Typically in plants where the column, e.g. 32, operating pressure is approximately 100 psig and above, there is enough energy available in the turboexpansion of the waste nitrogen to cover the normal refrigeration needs of the plant and to compress a substantial amount of the enriched oxygen recycle stream in order to increase nitrogen recovery. Such a scheme minimizes the amount of the equipment which must be installed, for example, a compressor wheel can be driven off the turboexpander shaft, and a heat exchanger for warming the oxygen recycle stream to ambient temperature prior to compression and cooling the compressed stream to low temperature following compression is eliminated. Of course, any such process which uses expansion of waste nitrogen to drive a compressor will reduce the amount of waste nitrogen available for turboexpansion. At some point, nitrogen recovery by compression of enriched oxygen recycle is maximized while sufficient nitrogen waste remains available to cover both the refrigeration needs of the plant and to supply the energy for the cold compressor. This equilibrium point depends upon the column operating pressure, the refrigeration needs of the plant, i.e. relating to its size and any liquid production requirements, the efficiencies of both the turboexpander and the cold compressor, etc. There are other factors, e.g., frictional pressure drops, and choice of temperatures of the fluids into both the turboexpander and the cold compressor, which also have a bearing on the equilibrium point.

The shaft output of the turboexpander is utilized to accomplish two distinct tasks: (1) driving a cold compressor of the waste nitrogen which is recycled to the distillation column, thereby improving the nitrogen recovery from the air feed to the distillation column, and (2) removing energy (as heat) from the cold process equipment by delivering a portion of a shaft energy to a dissipative brake in the surroundings.

Figure 4:
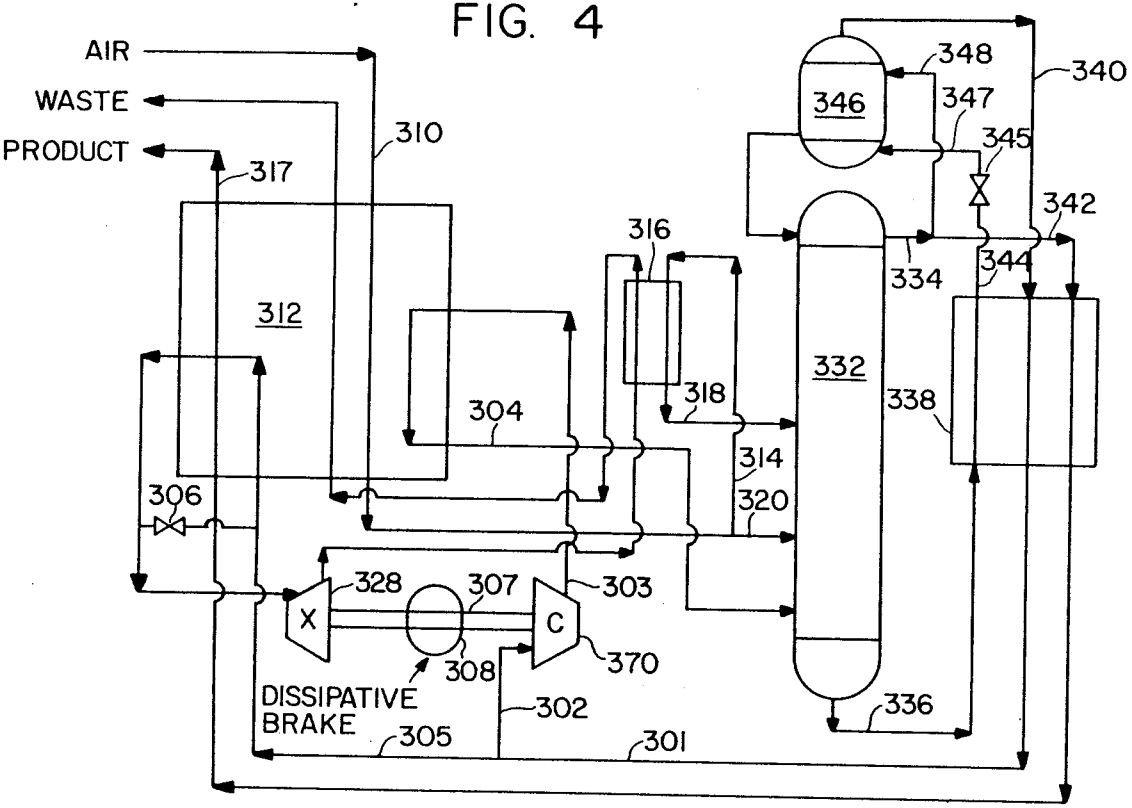
FIG. 4 is a schematic view of another embodiment of the invention using cold compression of the waste nitrogen recycle flow wherein at least a portion of the work output from the expander is used to operate the cold recycle compressor.

The embodiment illustrated in FIG. 4 shows the recycle of cold oxygen-rich gas, i.e. oxygen-rich gas that is compressed in its cold state without being warmed to ambient temperature in a heat exchanger. More specifically, the compressed and purified feed air 310 is cooled in heat exchanger 312. A portion 314 of the cooled air 310 is sent to an optional heat exchanger 316 where the air 314 is further cooled and condensed before passing via line 318 into an intermediate stage of the distillation column 332. The second portion 320 of the cooled air 310 is sent directly to another intermediate stage of the distillation column 332, but lower than the entry stage of line 318.

Air entering distillation column 332 is separated into a substantially pure gaseous nitrogen overhead 334 exiting at the top of column 332 and an oxygen enriched liquid bottoms 336 from the bottom of the column. The liquid 336 is cooled in optional heat exchanger 338 against oxygen enriched gas 340 and nitrogen product gas 342. The cooled liquid 344 is reduced in pressure through valve 345, and enters condenser 346 via line 347 where it boils while condensing a portion of the gaseous nitrogen product 348 through indirect heat exchange.

Oxygen enriched gas 340 is optionally warmed via heat exchanger 338, and a portion 302 of the warmed gas 301 enters the compressor 370 (without further warming to ambient). The compressed gas 303 is then returned via line 304 to the bottom of distillation column 332 after being cooled in heat exchanger 312. The remaining portion 305 of the warmed gas 301 is passed to the turboexpander 328 after passing through the heat exchanger 312. A bypass of heat exchanger 312 via valve 306 is provided. Of particular importance with respect to this embodiment is that a shaft connection 307 is provided between the turboexpander 328 and the compressor 370. In one embodiment, a portion of the work output of the turboexpander 328 is used to drive the compressor 370 thereby providing the "boil up" flow to distillation column 332 which enhances the recovery of nitrogen product 317. In this event, part of the work output is directed to a dissipative brake 308 to remove heat from the system and reject this heat to the surroundings. "Surroundings" means outside the cold box (not shown) boundaries of energy and flow. The dissipative brake 308 may be a compressor, a pump, electrical generator, or like device, or even friction in the bearings of a rotating part. It is important that the system directs requisite energy to the surroundings to keep the cold compression process refrigerated.

Figure 5:
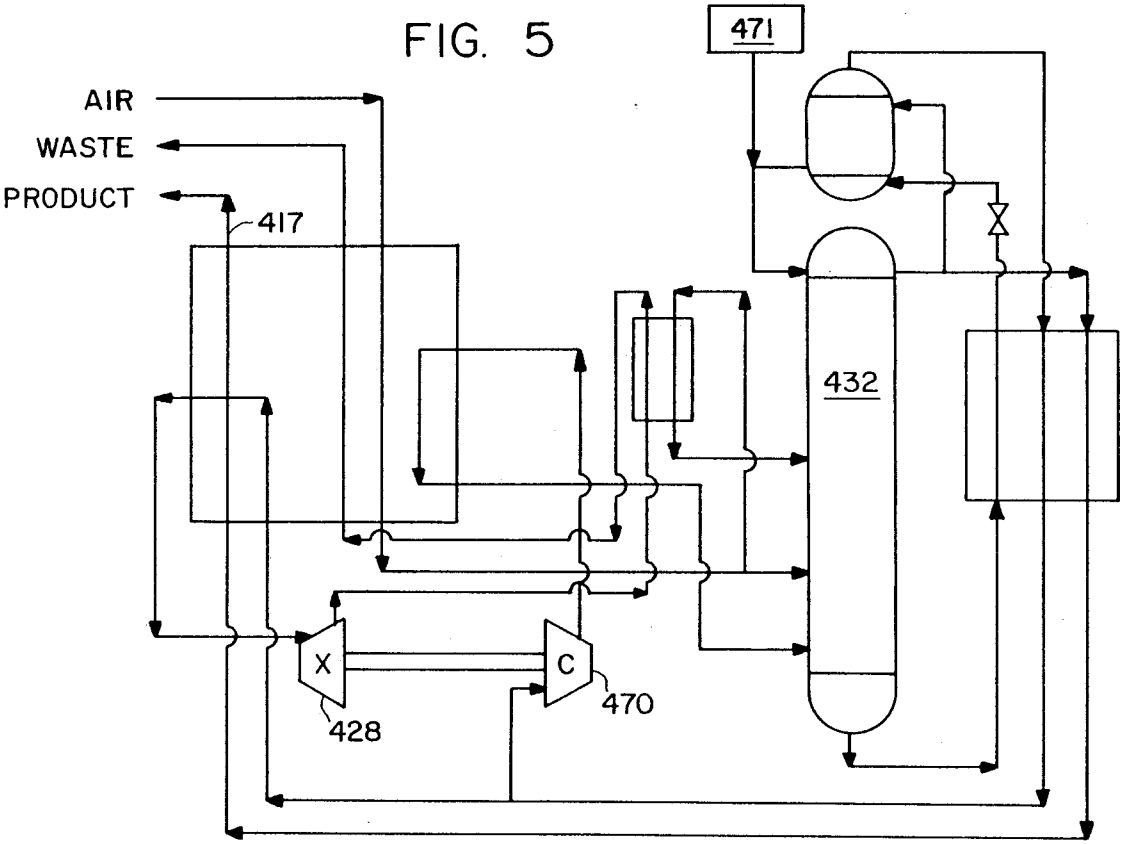
FIG. 5 is a schematic view of another embodiment of the invention using cold compression of the waste nitrogen recycle flow by means of the total available shaft work from the turboexpander, wherein refrigeration is supplied by an external source.

Whereas the process shown in FIG. 4 requires some of the turboexpander shaft output to supply a "dissipative" brake to refrigerate the plant, the process of FIG. 5 needs no dissipative brake because its refrigeration is provided from an outside source. The entire shaft output of the turboexpander can be applied to driving a compressor, thus even higher recoveries of nitrogen from the air fed to the distillation column are achievable. In another embodiment of cold compression, shown in FIG. 5, all of the available work output of the turboexpander 428 is supplied to the compressor 470. This enables a higher recovery of nitrogen product 417 to be obtained because an even greater boil up flow is achievable in column 432. In this event, refrigeration must be supplied to the system, for example, by supplying liquid nitrogen to the distillation column 432 from an external source 471, and there is no intentional dissipative brake.

If the external source 471 of refrigeration for the process of FIG. 5 is liquid nitrogen at or near the purity of the desired gaseous product of the plant, a proportional increase in gaseous nitrogen product the plant can result. The amount of refrigeration from an external source is a function of the heat leak and enthalpies associated with the plant fluid flows at the plant cold box boundaries.

The essential element of the invention shown in FIG. 5 is that the cold waste nitrogen compression is achieved by coupling the compressor 470 to the turboexpander 428 output exclusively, which is made possible by providing an external source of refrigeration. Such a scheme gains commerical attractiveness as the cost of supplying refrigerating substances 471 (e.g., liquid nitrogen) has diminished as producing plants for these liquids have become larger and more efficient.

The increase in nitrogen recovery made possible by dedicating the total output of the turboexpander 428 to recycle waste nitrogen compression further increases the amount of nitrogen gas per unit of liquid refrigerant 471 supplied, and therefore the economic return of the plant.

Another advantage of the process shown in FIG. 5 is that only two cold machines are required, preferably connected by a common shaft. The additional mechanical complication of the dissipative device of FIG. 4 is eliminated. Also, for FIGS. 4 and 5, prepurification of feed air is a preferred alternative to a reversing heat exchanger.

In another embodiment of cold compression (not shown), the energy for such compression comes from an external source, e.g., an electric motor. The electric motor is an external requirement and increases the refrigeration needs of the plant. However, these are also met by the turboexpander which is free of the necessity of supplying shaft energy to the cold compressor. Once again, however, as cold compression increases the recovery of nitrogen, the amount of waste nitrogen available for turboexpansion is reduced. When this is reduced to the quantity required to meet the refrigeration needs of the plant (including that from the external energy source driving the cold compressor), then the maximum recovery of nitrogen has been reached.

EXAMPLE 1

A process for the recovery of substantially pure nitrogen at the rate of 110,000 standard cubic feet per hour (SCFH) at 114.7 psia is conducted in accordance with FIG. 1. SCFH refers to a substance measured as a gas at 14.7 psia and 70° F.

A feed air flow of 185,169 SCFH was compressed to a pressure of 125.3 psia, aftercooled to a temperature of 100° F., and then cooled in the heat exchanger 12. The cooled air was sent via the line 18 at the rate of 183,336 SCFH and a temperature of −265.8° F. to the gas phase absorber 20 for the removal of impurities and for further cooling in the heat exchanger 24. The cooled air having a liquid content of 0.03 mole percent (−269.6° F. and 122.2 psia) was sent to an elevated tray (i.e. intermediate stage) of the distillation column 32.

Gaseous nitrogen at a pressure of 119.1 psia and a temperature of −278.4° F. exited from the top of the distillation column 32 and a portion was forwarded to the heat exchanger 38 where the nitrogen was warmed to −268.5° F. A flow of 109,980 SCFH was warmed in heat exchanger 12. The final product was cooled at a temperature of 94.6° F. and 118 psia to give a nitrogen recovery of about 59 mole percent based on total air compressed.

The oxygen enriched gas from condenser 46 passed through the heat exchanger 38 at the rate of 142,036 SCFH. A portion of this flow, 68,700 SCFH, passed completely through the heat exchanger 64 and was warmed to ambient temperature therein. The warmed gas was then compressed to 123.3 psia and aftercooled to 100° F. The cooled gas reentered the heat exchanger 64 and was cooled to −257.3° at a pressure of 122.5 psia for delivery to the bottom of the distillation column 32.

The balance of the oxygen enriched gas leaving the heat exchanger 38 was divided between the heat exchangers 64 and 12 and bypass line 58 to provide the feed gas to the turboexpander 28 and its bypass, a total of 73,336 SCFH, at a pressure of 51.4 psia and temperature of −235° F. A flow of 60,790 SCFH of this gas 60 passed through the turboexpander 28 providing requisite refrigeration. The turboexpander exhaust gas and the bypass was combined into line 26 and warmed in the heat exchangers 24 and 12.

EXAMPLE 2

A flow of 25,000 SCFH of nitrogen was produced in accordance with the process described in FIG. 4 wherein a portion of the work output from the turboexpander 328 was sent to the compressor 370 via the shaft 307 and the balance was transmitted out of the system.

An air flow of 51,546 SCFH was fed at a pressure of 133 psia through the heat exchanger 312. Then 1036 SCFH of the cooled air was sent through the heat exchanger 316 for condensing prior to delivery to an intermediate stage of the distillation column 332. The balance of the cooled air entered an elevated tray, below the entry stage of line 318, of the distillation column 332 directly. The products of the distillation column 332 are 65,758 SCFH nitrogen gas, of which 40,758 SCFH was returned as reflux after condensing in condenser 346, and 36,211 SCFH of oxygen rich liquid 336. The oxygen rich liquid 336 was subcooled in the heat exchanger 338 and throttled to about 68 psia for boiling in the condenser 346. Both boiled oxygen rich gas 340 and 25,000 SCFH nitrogen product 342 were warmed in heat exchanger 338. The warmed nitrogen product entered the main heat exchanger 312, warmed to ambient temperature, and exited the system via line 317.

The oxygen rich gas is divided into a portion for turboexpansion and a portion for cold compression of recycle gas for the distillation column, 26,546 SCFH and 9665 SCFH, respectively. The recycle gas was compressed to 130 psia, cooled in heat exchanger 312 and injected into the bottom of the distillation column 332 for "boil up." The gas to the turboexpander 328 was first heated partially in heat exchanger 312 and expanded to about 18 psia in turboexpander 328. It then passed through heat exchangers 316 and 312, yielding its refrigeration and becoming the waste nitrogen product of the plant.

By these means, a nitrogen recovery of about 48.5 mole percent of the feed air was attained. Various recoveries are achievable by this process, depending on the plant size, cold compressor and turboexpander efficiencies, the operating pressure of the distillation column, the number of trays in the distillation column, and the desired nitrogen purity.

In this Example 2, part of the shaft work generated by the turboexpander 328 must be transmitted to the surroundings and part to the cold compressor 303. Work transmitted to the surroundings by brake 308 constitutes the refrigeration necessary to refrigerate the plant.

EXAMPLE 3

The same procedure was follows as in Example 2 except that all of the available work output from the turboexpander 428 was used to operate the compressor 470 in order to maximize recovery of nitrogen as illustrated in FIG. 5. For a well insulated cold box, 949 SCFH of liquid nitrogen was added to the top of the distillation column 432 to provide refrigeration. An feed air of 51,546 SCFH was processed in the system to produce up to 30,000 SCFH of product nitrogen 417 resulting in a nitrogen recovery rate of about 58 mole percent of the feed air.

The present invention recovers substantially pure nitrogen product, both gas and liquid as desired, on the order of up to 70 mole percent. As plant size decreases, expecially below 800,000 SCFH, the present invention becomes more cost effective due to the absence of the standard column reboiler and the less expensive heat pump circuit comprising compression equipment.

A single turboexpander is not essential to this embodiment of the invention. If fact, one turboexpander serving the refrigeration needs of the plant and another driving the compressor for recycle to the column in order to provide higher nitrogen recovery is within the scope of the present invention. There are other combinations. The essential element is the cold compression of the recycle enriched oxygen liquid bottoms using shaft energy inherently produced in the process.

While particular embodiments of the invention have been described, it will be understood, of course, that the invention is not limited thereto since many obvious modifications can be made, and it is intended to include within this invention any such modifications as will fall within the scope of the invention as defined by the appended claims.

What is claimed is:

1. A process for the recovery of substantially pure nitrogen product at superatmospheric pressure from air comprising the steps of:

(a) compressing a gaseous feed air;

(b) cooling the compressed air in a heat exchanger against enriched oxygen and nitrogen product streams;

(c) introducing the cooled and compressed air to an intermediate stage of a single distillation column;

(d) separating a substantially pure gaseous nitrogen overhead and an oxygen enriched liquid bottoms from the column;

(e) forwarding substantially all of the oxygen enriched liquid bottoms and a first portion of the gaseous nitrogen overhead to a condenser and therein indirectly exchanging heat between the bottoms and overhead thereby boiling up an oxygen enriched gas stream and condensing a liquid nitrogen stream;

(f) recycling a first major portion of the liquid nitrogen stream to the top of the distillation column as a reflux;

(g) compressing at least a first portion of the oxygen enriched gas stream at about the temperature of the distillation column and recycling the compressed oxygen enriched gas stream to the bottom of the distillation column thereby enhancing nitrogen product recovery from the air;

(h) expanding a second portion of the oxygen enriched gas stream exiting the condenser in an expanding means thereby generating work output to both provide refrigeration for the process and to compress the first portion of the oxygen enriched gas stream which is recycled to the bottom of the distillation column;

(i) warming the second remaining portion of the gaseous nitrogen overhead in the heat exchanger against the compressed air; and (j) recovering the warmed nitrogen overhead as a substantially pure nitrogen product from the heat exchanger.

2. The process of claim 1 further comprising purifying the compressed air of step (b) by deposition of impurities in a reversing heat exchanger.

3. The process of claim 1 further comprising recovering as nitrogen product a second minor portion of the liquid nitrogen stream exiting the condenser.

4. The process of claim 1 wherein the removed portion of the work output which provides refrigeration is transferred to the surroundings as heat or work.

5. The process of claim 1 wherein all the work output is utilized to compress the first portion of the oxygen enriched gas stream which is recycled to the bottom of the distillation column, and further comprising adding refrigeration to the process from an external source.

6. The process of claim 5 wherein the step of adding refrigeration to the process comprises adding liquid nitrogen to the distillation column.

7. The process of claim 1 further comprising purifying the gaseous feed air external of the heat exchanger.

8. The process of claim 7 wherein the external purification means is a regenerable molecular sieve comprising a zeolitic material.

9. The process of claim 1 wherein the oxygen enriched gas stream of step (g) is compressed to a pressure slightly greater than the pressure of the distillation column.

10. An apparatus for the production of nitrogen product from air comprising:

(a) a first compressor for increasing the pressure of a gaseous feed air;

(b) a heat exchanger for cooling the high pressure air with products of the distilled feed air;

(c) a distillation column for separating the cooled air into a substantially pure gaseous nitrogen overhead and an oxygen enriched liquid bottom;

(d) a condenser for at least partially condensing the gaseous nitrogen overhead to form a liquid nitrogen stream via indirect heat exchange with oxygen enriched liquid bottoms to form an oxygen enriched gas stream;

(e) a first recycle means for returning a first major portion of the cold liquid nitrogen stream from the condenser to the distillation column as a reflux;

(f) a second compressor for increasing the pressure of a first portion of the oxygen enriched gas stream at about the temperature of the distillation column from the condenser;

(g) a second recycle means for returning the high pressure oxygen enriched gas stream to the bottom of the distillation column thereby enhancing nitrogen product recovery;

(h) an expansion means for expanding a second portion of the oxygen enriched gas stream from the condenser thereby generating work to provide refrigeration for the process and to power the second compressor;

wherein the nitrogen product is recovered from the first heat exchanger.

* * * * *